US005537179A

United States Patent [19]

Wernicke et al.

[11] Patent Number: 5,537,179

[45] Date of Patent: Jul. 16, 1996

[54] DEVICE AND PROCESS FOR THE RAPID WASHING OF PHOTOGRAPHIC MATERIAL

[75] Inventors: Ubbo Wernicke, Rösrath-Kleineichen; Egon Bachem, Burscheid, both of Germany

[73] Assignee: Bayer Aktiengesellschaft, Leverkusen, Germany

[21] Appl. No.: 151,930

[22] Filed: Nov. 15, 1993

[30] Foreign Application Priority Data

Nov. 24, 1992 [DE] Germany ..... 42 39 401.5

[51] Int. Cl.[6] ..... G03D 3/08; G03D 3/02

[52] U.S. Cl. ..... 354/320; 354/321; 354/322; 354/324; 354/325

[58] Field of Search ..... 354/319–324, 354/331, 336, 325; 134/64 P, 64 R, 122 R, 122 P

[56] References Cited

U.S. PATENT DOCUMENTS

| | | | |
|---|---|---|---|
| 4,875,067 | 10/1989 | Kanzaki et al. | 354/322 X |
| 4,933,699 | 6/1990 | Nakamura et al. | 354/320 |
| 5,239,328 | 8/1993 | Wernicke et al. | 354/320 |

FOREIGN PATENT DOCUMENTS

| | | | |
|---|---|---|---|
| 0545202A1 | 11/1992 | European Pat. Off. . | |
| 62-240970 | 10/1987 | Japan | 354/320 |

OTHER PUBLICATIONS

European Search Report No. 93118279.4, Feb. 3, 1994.

Patent Abstract of Japan, Publication No. JP62240970, Oct. 21, 1987.

Patent Abstract of Japan, Publication No. JP63018250, Jan. 26, 1988.

*Primary Examiner*—D. Rutledge

*Attorney, Agent, or Firm*—Connolly & Hutz

[57] ABSTRACT

A device for washing photographic material, comprising at least one washing tank and at least two rows of pairs of rollers, arranged one above another, above the liquid level of the tank, of which the first row is passed through by the photographic material in a descending direction and the second row is passed through by the photographic material in an ascending direction, wherein (a) the rollers of each pair of rollers are arranged paraxially to one another and contact the front and rear sides respectively of the photographic material conducted between them;

(b) the pressure exerted upon the photographic material by the rollers of at least one pair of rollers is set at 50 to 1000 p/cm$^2$ and (c) at least one pair of rollers of the descending row and at least one pair of rollers of the ascending row are provided with a water supply, permits particularly rapid washing using standard quantities of water.

7 Claims, 2 Drawing Sheets

DEVICE AND PROCESS FOR THE RAPID WASHING OF PHOTOGRAPHIC MATERIAL

BACKGROUND OF THE INVENTION

The invention relates to a device for the continuous washing of photographic materials comprising at least one tank filled with a liquid and two rows of pairs of rollers, arranged one above another, above the liquid level of the tank.

DESCRIPTION OF THE PRIOR ART

In photographic processing the photographic material (films/papers) passes through a multi-stage process, for example development, washing, bleaching, washing, fixing, washing, stabilization, drying or development, fixing, washing, drying.

To remove the water adhering to the photographic material as substantially as possible prior to the drying, initially so-called "wipers" were used. The drying operation is thereby accelerated and energy normally required to evaporate the adhering water is saved.

Occasionally these wipers are also used prior to and following the individual processing steps, in order to reduce the entrainment of the solutions. Rubber lips, which wipe the photographic material on one side or on both sides, are used for example for the aforementioned purposes.

Devices are also known with which the liquid adhering to the surface is blown away by compressed air. Another method is that of vacuum suction.

Whereas the generation of a vacuum requires a relatively high technical outlay, the simple use of compressed air has the disadvantage that the chemical solutions, in finely atomized form, reach locations at which disturbing crystal residues remain following the evaporation of the liquid.

Rubber lips also have the disadvantage that in the case of a relatively long period of use with a specific breadth of material, they are subject to greater wear at the edges than in the centre, and for this reason do not operate uniformly over the entire breadth of the material in the case of a change of format. Therefore they must frequently be renewed.

So-called squeezing rollers, through which the photographic material is conducted under pressure, are also frequently employed in photographic technology. These serve to remove the liquid adhering to the surface to some extent. Liquid and chemicals present in the gelatin layers of the photographic material are not removed by this means. Therefore the effectiveness of such a pair of rollers is inadequate.

Washing operations carried out between individual process steps or prior to the drying in order to remove adhering chemicals are lengthy and require a large quantity of water, even when the measures described in the aforegoing are employed.

SUMMARY OF THE INVENTION

The aim of the present invention is to make available a device which speeds up the washing without the consumption of an excessive quantity of water.

This aim is fulfilled by means of a device for washing photographic materials which has at least one washing tank and at least two rows of pairs of rollers, arranged one above another, above the liquid level of the tank. The photographic material is passed through the first row in a descending direction and the second row is passed in an ascending direction, and the rollers of each pair of rollers are arranged paraxially to one another. The rollers contact the front and rear sides respectively of the photographic material between them, the pressure exerted upon the photographic material by the rollers of at least one pair of rollers is set at 50 to 1000 pond/cm$^2$, and at least one pair of rollers of the descending row and at least one pair of rollers of the ascending row are provided with a water supply.

The material can be submerged in the water contained in the washing tank, but can also be conveyed across guide rollers located above the level of the bath.

Preferably the axes of each pair of rollers are adjusted in parallel to the horizontal plane or show an angle of up to 45° to the horizontal plane.

Preferably at least 50% of the pairs of rollers fulfill the above described pressure condition.

Preferably at least one roller of at least one pair of rollers is driven; in particular all the pairs of rollers are driven.

The surface of at least one roller of each pair of rollers preferably consists of an elastic material, preferably rubber. The other roller can likewise consist of an elastic material, but also for example of high-grade steel or hard plastic.

In a preferred embodiment of the device, the water supply is provided at the highest point of the second highest pair of rollers of that row of pairs of rollers through which the photographic material passes in an ascending direction. The photographic material which, having issued from the tank, is conveyed in an ascending direction between the rollers of each pair of rollers can thus be supplied with a small quantity of water, with the result that cascade washing using minimal quantities of water is carried out in an extremely confined space.

The device comprising pairs of rollers arranged one above another can be multiply provided, also multiply in respect of one tank, the applied water being conveyed in counterflow to the photographic material and optionally conveyed to the photographic material through baffles or guides.

In a preferred embodiment, the pairs of rollers through which the material passes in a descending direction are all individually supplied with water.

The water can either be directly applied to the photographic material or can be indirectly applied to the photographic material by wetting the rollers, for example with a moist sponge.

The device also preferably comprises means with which the water from the pairs of rollers through which the material passes in an ascending direction, on the removal of said water from the photographic material, is conveyed into the preceding treatment stage.

BRIEF DESCRIPTION OF THE DRAWINGS

The device according to the invention will be described in detail in FIG. 1. A device according to the prior art is shown in FIG. 2.

DETAILED DESCRIPTION OF THE INVENTION

Figure 1:
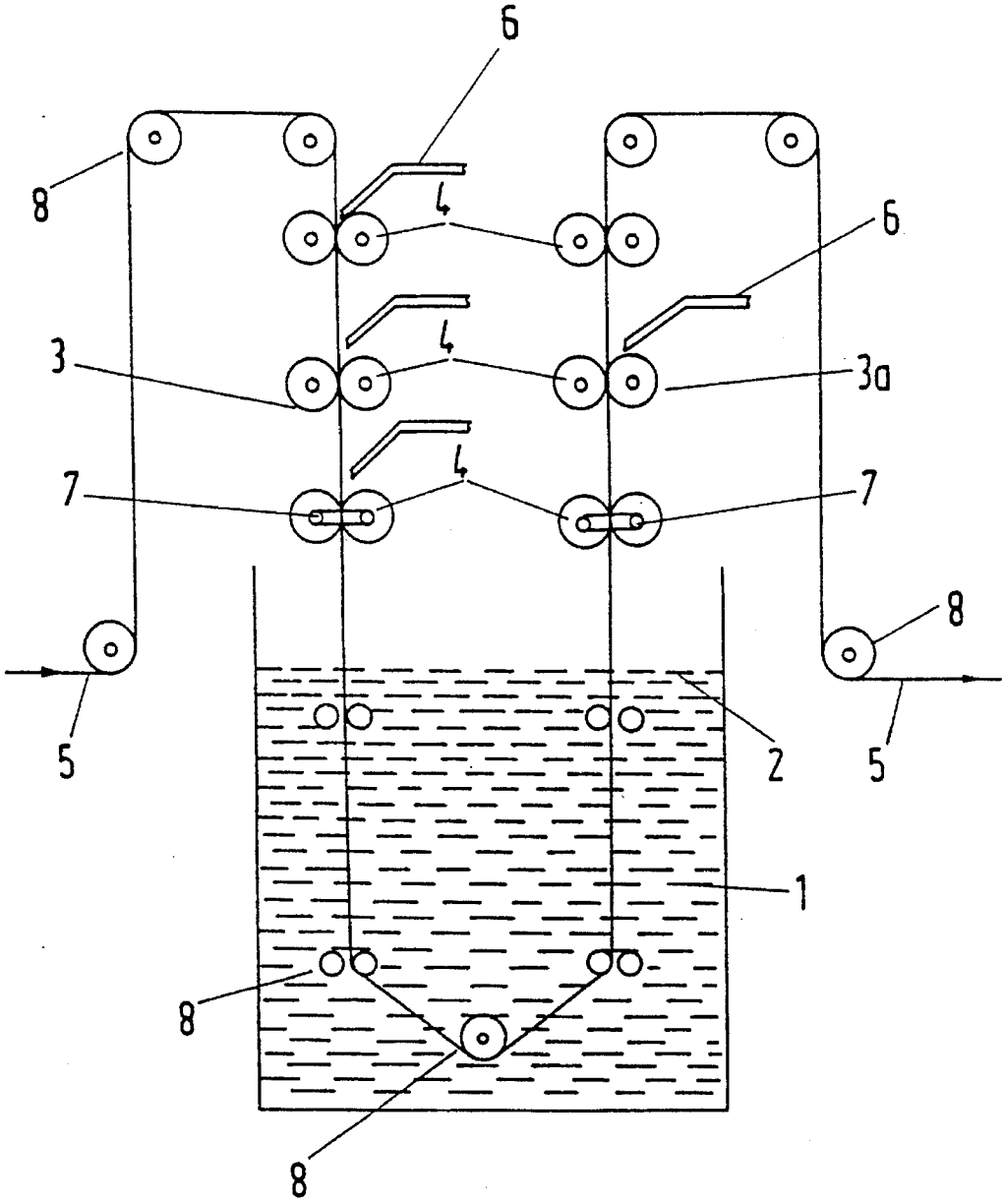

In FIG. 1 (1) designates a washing tank inside a photographic processing apparatus, the water level of which has been designated (2). On a frame (not shown), two rows (3) and (3*a*) of pairs of rollers (4) are arranged one above another, of which one pair of rollers is in each case provided with drive means (not shown). (5) designates the photographic material with its direction of travel indicated by an arrow, while (6) designates a device component with which washing water is applied to the pairs of rollers. The washing water can be applied to one side or both sides of the photographic material and in the case of row 3*a* passes externally around the rollers before reaching the next pair of rollers, until it finally drips into the tank (1). Reference numeral (7) designates a device which serves to set the pressure between the two rollers of the pair of rollers. Reference numeral (8) designates conventional guide rollers. In the case of row (3), fresh water is applied to each pair of rollers. The water is then discharged and conveyed for example to a tank (not shown).

Figure 2:
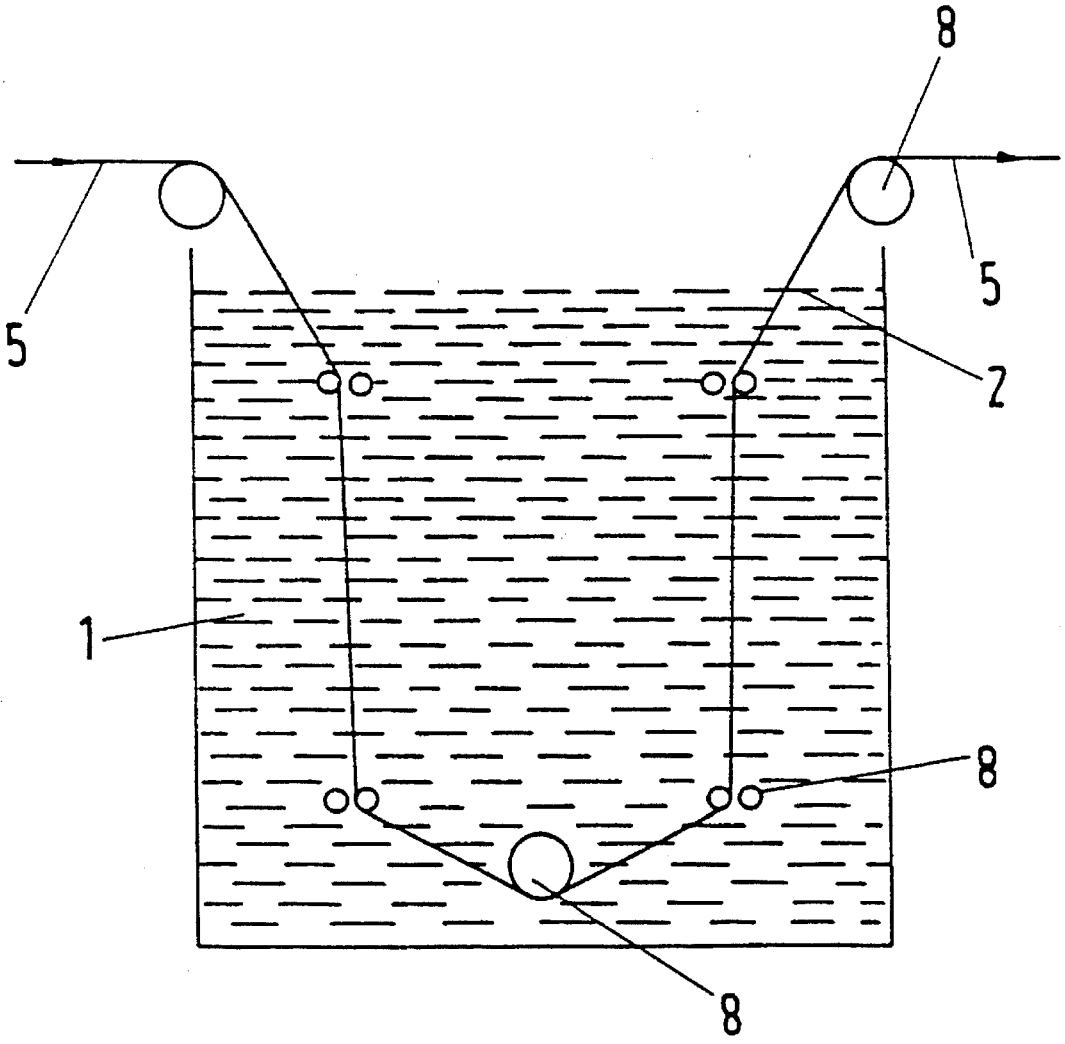

The washing tank (1) shown in FIG. 2 with the water level (2), through which the photographic material (5) is conveyed, comprises only the standard guide rollers (8).

Preferably in each tank each row comprises two to twenty, in particular three to fifteen pairs of rollers, the breadth of which is adapted to the photographic material to be processed. The diameter of the rollers is non-critical; for reasons of space diameters of between 1 and 10 cm will be selected.

The contact pressure of the pairs of rollers is set, for example, by tension springs which are mounted around both axes of the rollers.

The invention further relates to a washing process for a photographic material which has been previously treated with a chemical solution, for example a developing-, bleaching-, fixing- or.

The water is preferably conveyed into the bath from which the material has just issued.

EXAMPLE 1 (comparison)

Following development and washing, a commercially available color paper passes through a bleaching bath having the following chemical composition:

Ammonium-iron-EDTA 35 g/l

Ammonium bromide 70 g/l.

The bleaching bath is followed by two washing tanks having a tank volume of 8.5 liters.

Washing tank 1—directly following the bleaching bath is regenerated with 150 ml/m$^2$ fresh water.

Washing tank 2—contains standing water with no fresh water supply.

Following the processing of 100 m$^2$ colour paper, the cleaning efficiency of washing tank 1 was determined by analyzing the $NH_4Br$-concentration in washing tank 2. At this time washing tank 2 contains 4.1 g $NH_4Br$/l.

EXAMPLE 2 (comparison)

The procedure according to Example 1 was followed, but a row of four driven pairs of rollers, arranged one above another, was mounted in the washing tank 1 and the water itself was discharged from the tank. The colour paper passed the pairs of rollers after leaving the washing tank.

Additionally the water supply to tank 1 was shut off and instead 150 ml/m$^2$ water was dripped onto the upper pair of rollers.

The pressure with which the four pairs of rollers contacted one another was approximately 700 p/cm$^2$ ($\Delta$ pond/cm$^2$). The unit p=98 pa (Pascal).

The cleaning efficiency of the arrangement was again determined by analyzing the $NH_4Br$-concentration in tank 2: 0.39 g/l.

EXAMPLE 3 (invention)

The procedure according to Example 2 was followed, but four additional pairs of rollers were installed one above another at the inlet to the tank 1, through which additional pairs of rollers the material passes in a descending direction and which contacted one another likewise with a pressure of approximately 700 p/cm$^2$. The device contained:

four wetting points a 25 ml/m$^2$ in the case of all the pairs of rollers of the descending portion;

one wetting point a 50 ml/m$^2$ in the case of the second from the top pair of rollers of the ascending portion.

Again the cleaning efficiency was determined by analyzing the $NH_4Br$-concentration in tank 2: 0.09 g/l.

With the preferred embodiment, a further increase in cleaning efficiency of a factor of 4 is detected.

EXAMPLE 4 (comparison)

Following development, washing, bleaching and washing a commercially available colour paper passes through a fixing bath having the following chemical composition:

sodium thiosulphate 120 g/l sodium sulphite 10 g/l.

The fixing bath is followed by two washing tanks having a tank volume of 8.5 liters each. Washing tank 1, directly following the fixing bath, is replenished with 120 ml/m$^2$ of fresh water. Washing tank 2 contains water with no fresh water supply.

After the processing of 100 m$^2$ continuous material with a width of 8.9, the sodium thiosulphate content in washing tank II was determined analytically. This represents a gauge for the entrainment which occurs in the case of 120 ml/m$^2$ washing in tank I.

11.8 $Na_2S_2O_3$/1 was detected in tank II.

EXAMPLE 5 (in accordance with the invention)

The procedure according to Example 4 was followed, but according to Example 3 two rows of four driven pairs of rollers each arranged one above another were mounted in washing tank I and the water itself was discharged from the tank.

The water supply to tank 1 was also shut off and instead four wetting points a 20 ml/m$^2$ in the case of all pairs of rollers of the descending portion; one wetting point a 40 ml/m$^2$ in the case of the second from top pair of rollers of the ascending portion were provided.

The pressure with which the four pairs of rollers of the row which the paper passes after leaving the bath contacted one another was approximately 700 p/cm$^2$.

The sodium thiosulphate concentration in washing tank II was again determined (analytically).

Tank II: sodium thiosulphate 2.9 g/l.

When the same quantity of water is used for washing stage I, improved cleaning of the material is obtained.

The examples indicate that by the use of the device according to the invention, highly efficient washing is achieved using small quantities of water. If a washing result according to Example 1 is considered adequate, the washing time can be substantially reduced, for example from 90 s in Example 1 to 25 s.

I claim:

1. A device for washing photographic materials comprising at least one washing tank and at least two rows of pairs of rollers, arranged one above another, above the liquid level of the tank, of which the first row is passed through by the photographic material in a descending direction and the second row is passed through by the photographic material in an ascending direction, wherein (a) the rollers of each pair of rollers are arranged paraxially to one another and contact the front and rear sides respectively of the photographic material conducted between them;

(b) the pressure exerted upon the photographic material by the rollers of at least one pair of rollers is set at 50 to 1000 p/cm$^2$ and (c) at least one pair of rollers of the descending row and at least one pair of rollers of the ascending row are provided with a water supply.

2. A device as claimed in claim 1, wherein at least 50% of the pairs of rollers fulfill the pressure conditions of claim 1.

3. A device as claimed in claim 1, wherein at least one roller of the minimum of one pair of rollers is driven.

4. A device as claimed in claim 1, wherein the surface of at least one roller of each pair of rollers consists of an elastic material, preferably rubber.

5. A process for the continuous washing of a photographic material which is conveyed along a U-shaped path, characterised in that both in the descending direction and in the ascending direction said photographic material passes through a plurality of pairs of rollers, the rollers of which contact the front and rear sides respectively of the material, and of which at least the rollers of one pair of rollers subject the photographic material to a pressure which is set at 50 to 1000 p/cm$^2$, and that water is supplied to at least one pair of rollers.

6. A process a claimed in claim 2, wherein at least 50% of the pairs of rollers exert a pressure of 50 to 1000 p/cm$^2$ upon the photographic material.

7. A process as claimed in claim 5, wherein after the washing, the applied water is conveyed into the preceding bath.

* * * * *